US010982917B1

(12) United States Patent
Schober

(10) Patent No.: US 10,982,917 B1
(45) Date of Patent: Apr. 20, 2021

(54) GUN SLIDE GALLING PREVENTION SYSTEM

(71) Applicant: John C. Schober, Houston, TX (US)

(72) Inventor: John C. Schober, Houston, TX (US)

( * ) Notice: Subject to any disclaimer, the term of this patent is extended or adjusted under 35 U.S.C. 154(b) by 0 days.

(21) Appl. No.: 16/383,515

(22) Filed: Apr. 12, 2019

Related U.S. Application Data

(60) Provisional application No. 62/656,529, filed on Apr. 12, 2018.

(51) Int. Cl.
*F41A 3/66* (2006.01)

(52) U.S. Cl.
CPC ..... *F41A 3/66* (2013.01)

(58) Field of Classification Search
CPC ..... F41A 3/64; F41A 3/66
USPC ..... 42/14, 16; 89/196
See application file for complete search history.

(56) References Cited

U.S. PATENT DOCUMENTS

| | | | | |
|---|---|---|---|---|
| 3,411,407 | A * | 11/1968 | Pachmayr | F41A 3/64 89/196 |
| 4,463,655 | A * | 8/1984 | Krieger | F41C 27/00 89/196 |
| 5,033,217 | A * | 7/1991 | Brennan | F41A 3/64 42/1.01 |
| 9,310,160 | B1 * | 4/2016 | DiChario | F41C 23/10 |
| 2013/0036644 | A1 * | 2/2013 | Bardy | F41A 3/64 42/69.03 |
| 2013/0133235 | A1 * | 5/2013 | Lippard | F41A 17/56 42/14 |
| 2017/0205163 | A1 * | 7/2017 | Fumia | F41A 3/66 |

* cited by examiner

*Primary Examiner* — Bret Hayes
(74) *Attorney, Agent, or Firm* — Richard Eldredge; Eldredge Law Firm

(57) ABSTRACT

A gun slide galling prevention system includes a gun with a slide forming an elongated body. The elongated body includes a thickness and an inner surface along with an elongated cavity extending inwardly from the inner surface and into the thickness. The system also includes a rail separated from the slide and configured to extend a length of the elongated body and an insert having a configuration of the elongated cavity, the insert fits within the elongated cavity and remains flush with inner surface, the insert forming a channel configured to receive the rail therein.

1 Claim, 5 Drawing Sheets

GUN SLIDE GALLING PREVENTION SYSTEM

BACKGROUND

1. Field of the Invention

The present invention relates generally to firearm systems, and more specifically, to automatic pistols and their slides that closes the chamber, ejects spent casing and charges the subsequent round.

2. Description of Related Art

Firearm systems are well known in the art and are effective means to discharge projectiles for hunting, self-defense and the like. For example, FIG. 1 depicts a conventional automatic pistol system 101 where the slide 103 travels along a guide 105 of a handle 107 each time a round is discharged.

One of the problems commonly associated with system 101 is its limited use. For example, because of the repetitive motion, the slide is subjected to wear and galling.

Additionally, the wear and galling limits the types of materials that can be used to form a slide.

Accordingly, although great strides have been made in the area of automatic pistol systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
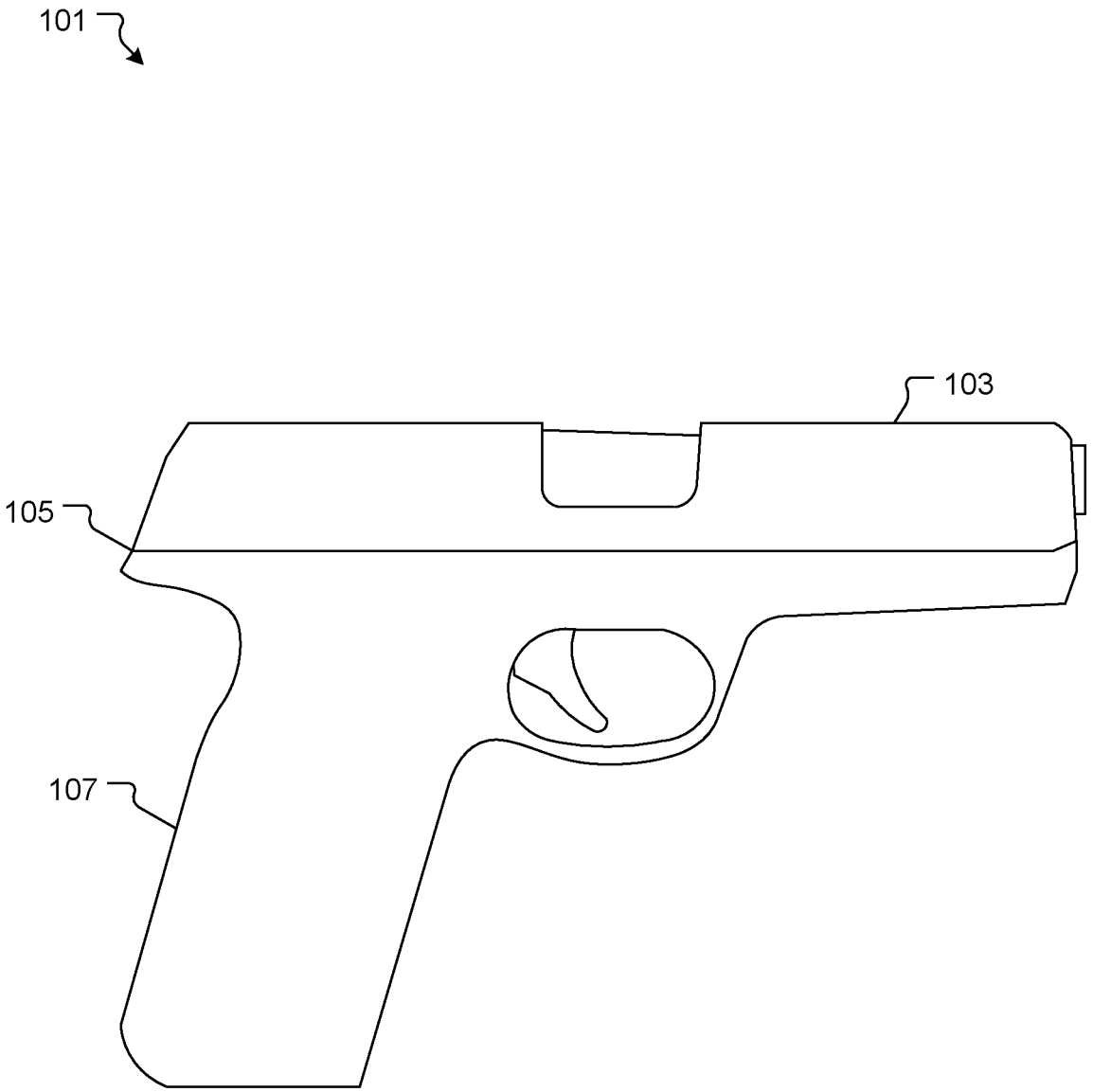
FIG. 1 Prior Art
FIG. 1 is a side view of a common automatic pistol system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous, implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional automatic pistol systems. Specifically, the invention of the present application reduces the wear on the slide, including galling. In addition, the present invention enables the use of additional materials in the forming of a slide. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
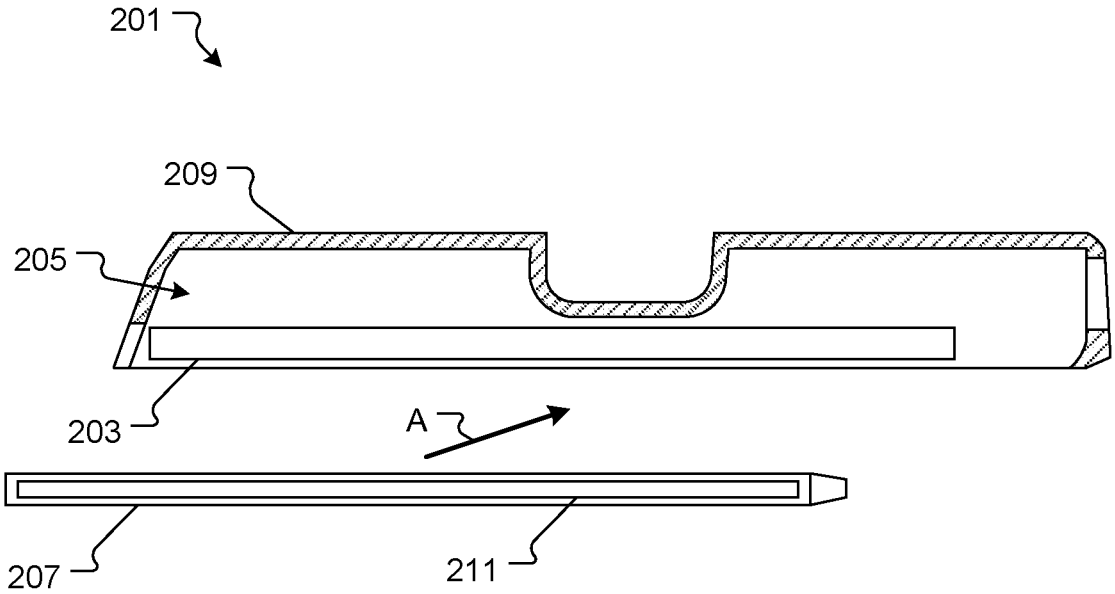
FIGS. 2A and 2B are cross-sectional side views of a gun slide galling prevention system in accordance with a preferred embodiment of the present application.
Figure 2B:
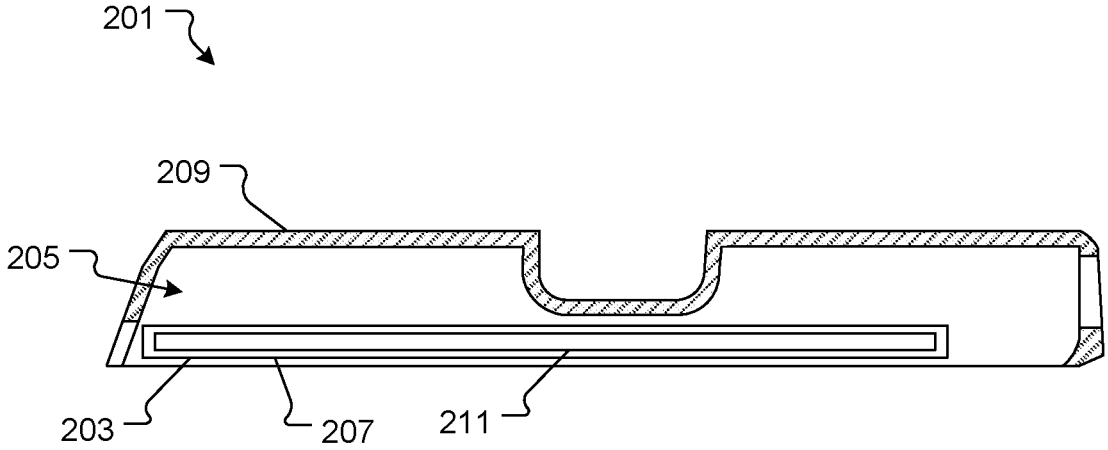

Referring now to the drawings wherein like reference characters identify corresponding or similar elements throughout the several views, FIGS. 2A and 2B depict cross-sectional side views of a gun slide galling prevention system in accordance with a preferred embodiment of the present application. It will be appreciated that system 201 overcomes one or more of the above-listed problems commonly associated with conventional automatic pistol systems.

Figure 3:
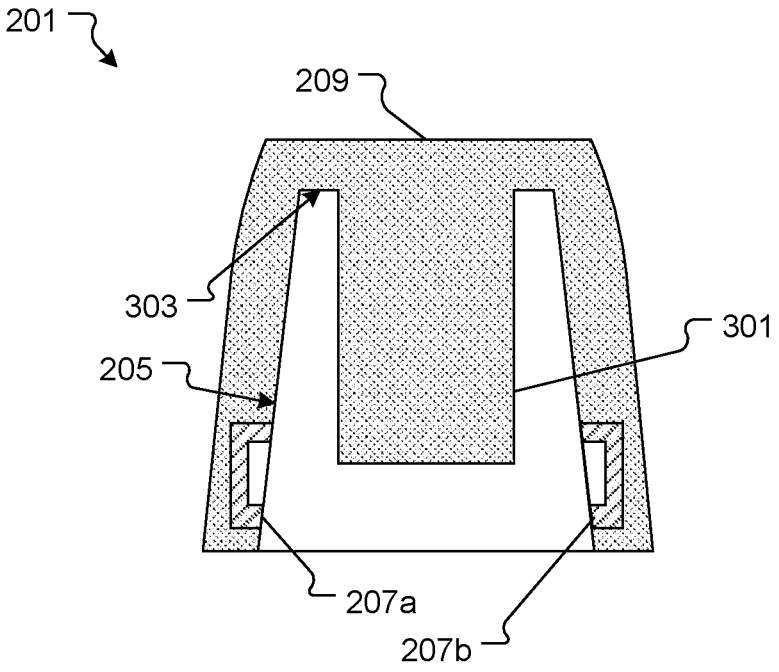
FIG. 3 is a cross-sectional back view of the slide of FIGS. 2A and 2B.

In the contemplated embodiment, system 201 includes a cavity 203 on either inner side 205 of a slide 209. Inserts 207A and 207B is placed in each cavity 203 as depicted by motion A. The inserts 207A and 207B having a track 211 extending inward along the length thereof from the inside surface. As depicted in FIG. 3, the inserts 207A and 207B are held in place firstly by a protrusion 301 that extends down from the inner top surface 303 of the slide 209.

Figure 4:
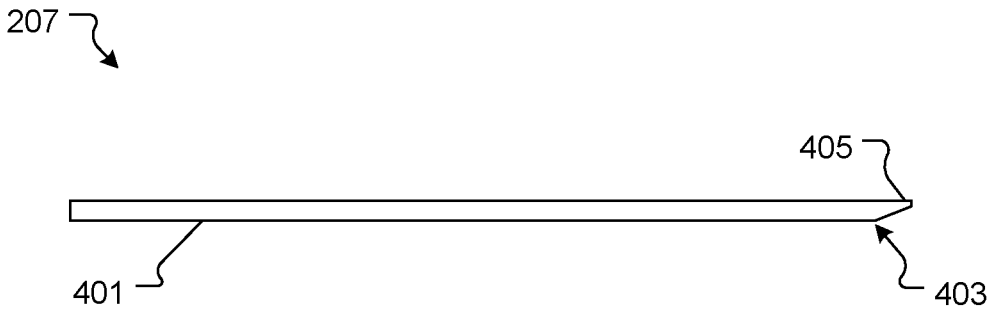
FIG. 4. is a top view of the insert of FIGS. 2A and 2B.

Referring now to FIG. 4 an insert 207 is depicted. The insert 207 having a body 401 with a first end 403 forming an arm 405 that narrows as it extends away from the body 401. The arm nests in a pocket of the cavities 203 as a secondary method of retaining the inserts 207A and 207B in the cavities 203.

Figure 5:
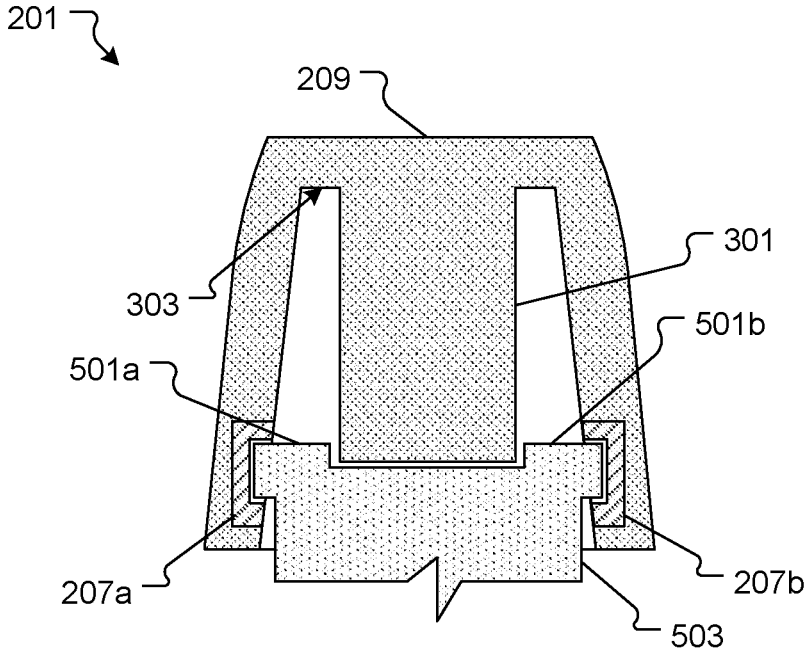
FIG. 5 is a cross-sectional back view of the system of FIGS. 2A and 2B.

In use, as depicted in FIG. 5 the inserts 207A and 207B with their tracks 211 are inserted into the cavities 203 of the slide 209. When the associated firearm is used, the rails 501 of a pistol 503 travel along the tracks 211 as the slide moves 209 during the discharge of a round. The inserts 207A and 207B protect both the slide 209 and the rails 501 from wear during use.

It should be appreciated that one of the unique features believed characteristic of the present application is that inserts 207A and 207B prevent wear on the slide 209 and pistol during use. It will also be appreciated that the inserts 207A and 207B can be easily replaced if they become worn.

Figure 6:
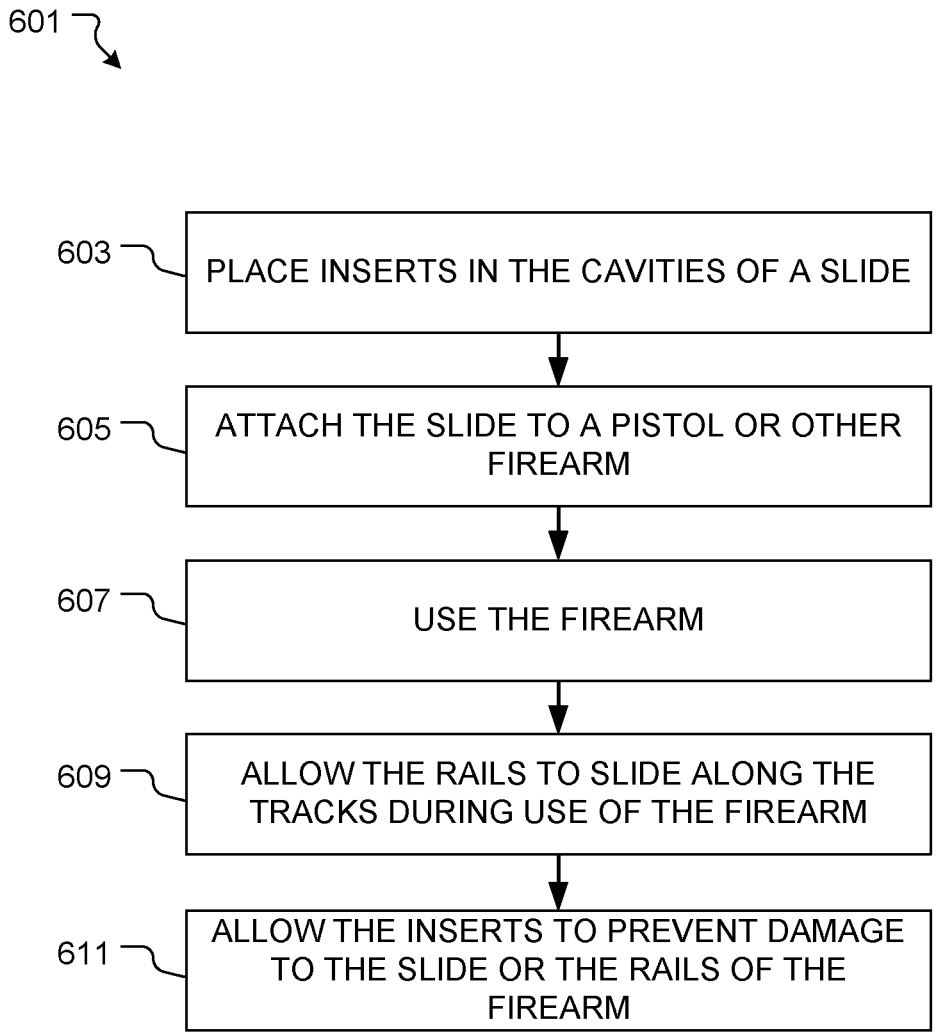
FIG. 6 is a flowchart of the preferred method of use of the system of FIGS. 2A and 2B.

Referring now to FIG. 6 the preferred method of use of the system 201 is depicted. Method 601 includes placing inserts in the cavities of a slide 603, attaching the slide to a pistol or other firearm 605, using the firearm 607, allowing the rails to slide along the tracks during use of the firearm 609 and allowing the inserts to prevent damage to the slide or rails of the firearm 611.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A gun slide galling prevention system, comprising:

a gun having:

a slide forming an elongated body, the elongated body having:

a thickness and an inner surface; and an elongated cavity extending inwardly from the inner surface and into the thickness; and a rail separated from the slide and configured to extend a length of the elongated body;

an insert having a configuration of the elongated cavity, the insert fits within the elongated cavity and remains flush with inner surface, the insert forming a channel configured to receive the rail therein;

wherein the rail slidingly engages with and rests in the channel of the insert.

* * * * *